US007441346B2

(12) United States Patent
Hardy et al.

(10) Patent No.: US 7,441,346 B2
(45) Date of Patent: Oct. 28, 2008

(54) ATHLETIC SHOE WITH INDEPENDENT SUPPORTS

(75) Inventors: Carl Hardy, Medfield, MA (US); Christopher Mahoney, Westford, MA (US)

(73) Assignee: Saucony, Inc., Lexington, MA (US)

( * ) Notice: Subject to any disclaimer, the term of this patent is extended or adjusted under 35 U.S.C. 154(b) by 272 days.

(21) Appl. No.: 11/024,079

(22) Filed: Dec. 28, 2004

(65) Prior Publication Data

US 2006/0137220 A1 Jun. 29, 2006

(51) Int. Cl.
*A43B 13/18* (2006.01)
*A43B 13/16* (2006.01)

(52) U.S. Cl. ..... 36/25 R; 36/28; 36/31; 36/114

(58) Field of Classification Search ..... 36/34 R, 36/92, 35 R, 31, 114, 25 R, 28
See application file for complete search history.

(56) References Cited

U.S. PATENT DOCUMENTS

| | | | | |
|---|---|---|---|---|
| 2,048,683 | A | 7/1936 | Brockman | |
| 2,402,534 | A | 6/1946 | Crum | |
| 3,822,490 | A | 7/1974 | Murawski | |
| 4,741,114 | A * | 5/1988 | Stubblefield | 36/32 R |
| 4,878,301 | A | 11/1989 | Kiyosawa | |
| 5,070,629 | A * | 12/1991 | Graham et al. | 36/27 |
| D344,174 | S | 2/1994 | Kilgore | |
| D344,398 | S | 2/1994 | Kilgore | |
| D344,399 | S | 2/1994 | Kilgore | |
| D344,400 | S | 2/1994 | Kilgore | |
| D344,401 | S | 2/1994 | Kilgore | |
| D344,622 | S | 3/1994 | Kilgore | |
| D350,018 | S | 8/1994 | Kilgore | |
| D350,019 | S | 8/1994 | Kilgore | |
| D350,020 | S | 8/1994 | Kilgore | |
| D350,225 | S | 9/1994 | Kilgore | |
| D350,226 | S | 9/1994 | Kilgore | |
| D350,227 | S | 9/1994 | Kilgore | |
| D350,433 | S | 9/1994 | Kilgore | |
| D351,057 | S | 10/1994 | Kilgore | |
| D351,720 | S | 10/1994 | Kilgore | |
| D351,936 | S | 11/1994 | Kilgore | |
| D352,159 | S | 11/1994 | Kilgore | |
| D352,160 | S | 11/1994 | Kilgore | |
| D354,617 | S | 1/1995 | Kilgore | |
| D355,755 | S | 2/1995 | Kilgore | |

(Continued)

OTHER PUBLICATIONS www.aviadirect.com/footwear, printed on Nov. 29, 2004 (8 pages).

(Continued)

*Primary Examiner*—Marie Patterson
(74) *Attorney, Agent, or Firm*—Wolf, Greenfield & Sacks, P.C.

(57) ABSTRACT

An athletic shoe sole construction having a suspension system designed to resiliently support a foot and deflect downwardly upon foot imposed forces is provided. The athletic shoe includes a plurality of independent supports arrayed about the periphery of the suspension system. The supports, or pillars, may include a ground engaging section and a resilient section intermediate the ground engaging section and the suspension system. The suspension system may include a deflectable grid system, or it may include other resilient deflectable materials. The pillars may be constructed and arranged to deflect independently of an adjacent pillar.

17 Claims, 6 Drawing Sheets

U.S. PATENT DOCUMENTS 5,390,430 A * 2/1995 Fitchmun et al. ..... 36/30 R
5,402,588 A 4/1995 Graham et al.
5,440,826 A * 8/1995 Whatley ..... 36/25 R
5,561,920 A * 10/1996 Graham et al. ..... 36/27
5,577,334 A 11/1996 Park
5,595,002 A 1/1997 Slepian et al.
D378,012 S 2/1997 Le
5,625,963 A 5/1997 Miller et al.
5,628,128 A 5/1997 Miller et al.
5,647,145 A 7/1997 Russell et al.
5,718,063 A 2/1998 Yamashita et al.
5,761,831 A 6/1998 Cho
5,797,199 A 8/1998 Miller et al.
5,852,886 A * 12/1998 Slepian et al. ..... 36/27
5,860,226 A * 1/1999 Graham et al. ..... 36/28
5,907,911 A 6/1999 Huang
5,974,695 A * 11/1999 Slepian et al. ..... 36/27
5,987,780 A * 11/1999 Lyden et al. ..... 36/29
6,061,930 A 5/2000 Zinovieff
D429,877 S 8/2000 Lozano et al.
D431,898 S 10/2000 Clegg et al.
D433,216 S 11/2000 Avar et al.
6,195,918 B1 3/2001 Kelley et al.
6,226,900 B1 5/2001 Mazars
6,233,846 B1 * 5/2001 Sordi ..... 36/28
D446,387 S 8/2001 McCourt
D446,923 S 8/2001 McCourt
D447,330 S 9/2001 McCourt
6,438,873 B1 * 8/2002 Gebhard et al. ..... 36/114
D462,830 S 9/2002 Greene
6,457,261 B1 10/2002 Crary
6,487,796 B1 * 12/2002 Avar et al. ..... 36/28
6,598,320 B2 7/2003 Turner et al.
6,601,042 B1 7/2003 Lyden
6,601,321 B1 * 8/2003 Kendall ..... 36/88
6,604,300 B2 * 8/2003 Meschan ..... 36/25 R
6,634,121 B2 * 10/2003 Sordi ..... 36/102
D483,936 S 12/2003 Fullum
D483,937 S 12/2003 Fullum
D485,053 S 1/2004 McDowell
D485,975 S 2/2004 McDowell
6,694,642 B2 2/2004 Turner
6,722,058 B2 * 4/2004 Lucas et al. ..... 36/28
6,729,046 B2 * 5/2004 Ellis, III ..... 36/25 R
6,769,202 B1 8/2004 Luthi et al.
6,931,765 B2 * 8/2005 Lucas et al. ..... 36/35 R
2001/0032399 A1 10/2001 Litchfield et al.
2002/0129516 A1 * 9/2002 Lucas et al. ..... 36/35 R
2002/0144430 A1 10/2002 Schmid
2003/0154628 A1 8/2003 Gyr
2004/0107601 A1 6/2004 Schmid
2004/0168352 A1 9/2004 Lucas et al.

OTHER PUBLICATIONS

International Search Report and Written Opinion May 4, 2006 of PCT/US2005/045009.

* cited by examiner

ATHLETIC SHOE WITH INDEPENDENT SUPPORTS

FIELD OF INVENTION

The present invention relates to a shoe construction and more particularly to a shoe sole having improved energy return characteristics.

BACKGROUND OF INVENTION

There is a continued interest in improving the performance characteristics of athletic shoes. Much of the recent industry interest continues to relate to the manufacture of footwear having energy return characteristics.

One type of energy return system employs the use of netting or a mesh arrangement in selected portions of the sole construction. For example, U.S. Pat. No. 5,070,629, issued Dec. 10, 1991, discloses an energy return system that includes a rigid frame with a set of monofilaments or fibers secured under tension across the frame. The monofilaments or fibers form a spring-like grid system that stores energy during the compression portions of the gait cycle and releases energy during the push-off phase of the gait cycle. U.S. Pat. No. 5,402,588, issued Apr. 4, 1995, U.S. Pat. No. 5,561,920, issued Oct. 8, 1996, U.S. Pat. No. 5,595,002, issued Jan. 21, 1997, U.S. Pat. No. 5,852,886, issued Dec. 29, 1998, and U.S. Pat. No. 5,974,695, issued Nov. 2, 1999 disclose various improvements to this spring-like energy return system, all of which are herein incorporated by reference in their entirety.

It is an object of the present invention to provide an improved energy return system for a shoe.

SUMMARY OF INVENTION

In one embodiment of the present invention, an athletic shoe having a transversely extending suspension system designed to resiliently support a foot and deflect downwardly upon foot imposed forces is provided. The athletic shoe has a plurality of independent supports arrayed about the periphery of the suspension system, extending downwardly therefrom. The supports include a ground engaging section and a resilient section intermediate the ground engaging section and the suspension system, and the supports collectively provide a flexible resilient support for the suspension system.

In another embodiment of the present invention, an athletic shoe sole construction is provided. The athletic shoe sole includes a transversely extending suspension system designed to resiliently support a foot and deflect downwardly upon foot imposed forces, and an independent support structure positioned underneath the suspension system. The support structure includes a plurality of ground contacting surfaces extending about the periphery of the heel portion of the shoe sole, and a plurality of resilient sections positioned between the ground contacting surfaces and the suspension system, where deflection of a first resilient section is independent from the deflection of an adjacent second resilient section.

In yet another embodiment of the present invention, an athletic shoe construction having a transversely extending suspension system designed to resiliently support a foot and deflect downwardly upon foot imposed forces is provided. The athletic shoe has a structure supporting the midsole from below, which includes a plurality of pillars arranged around the periphery of the heel portion of the midsole, where a first pillar is constructed and arranged to deflect independently of an adjacent second pillar.

BRIEF DESCRIPTION OF DRAWINGS

Various embodiments of the invention will now be described, by way of example, with reference to the accompanying drawings, in which.

DETAILED DESCRIPTION

Figure 1:
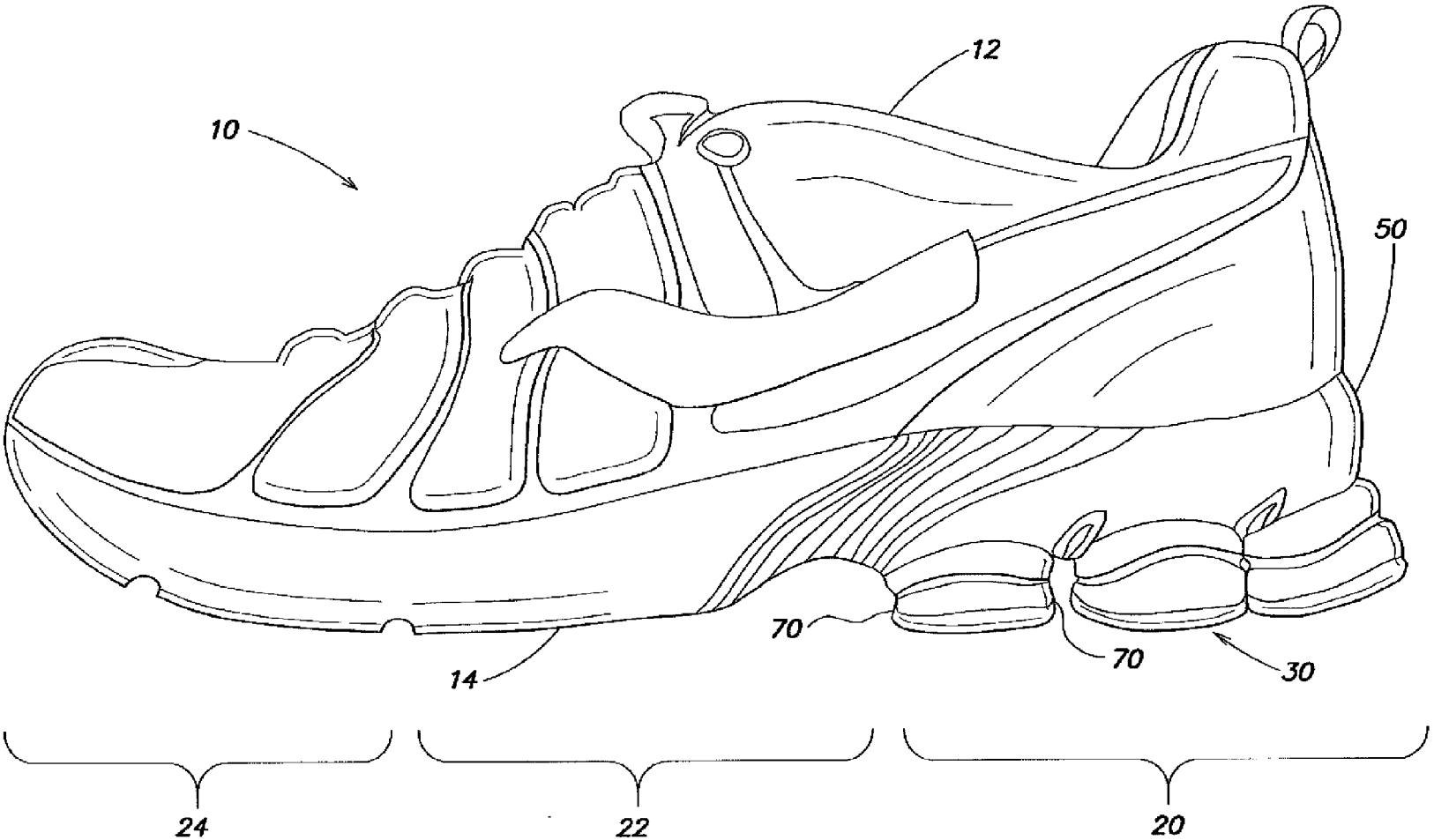
FIG. 1 is a lateral side view of a shoe having a plurality of independent supports in the heel section.

Aspects of the invention are directed to a shoe sole construction having an energy return system. The energy return system of the present invention includes the use of components in the midsole and/or outsole region that provide both cushioning and energy return characteristics. These components may be selectively employed in the heel, midfoot, and/or forefoot portions to provide the desired energy return characteristics for a particular type of shoe. These components may be especially designed for use in athletic shoes such as walking shoes, cross-training shoes, basketball shoes, and running shoes.

In one embodiment, the design of an athletic shoe sole includes a suspension system designed to resiliently support a foot and deflect upon foot imposed forces. In one embodiment, the shoe sole of the present invention is designed to minimize the amount of material located in the shoe below the suspension system, to maximize the amount of possible deflection of the suspension system. In another embodiment, the shoe sole includes a plurality of independent supports arrayed about the periphery of the suspension system, where the independent supports are arranged to resiliently deflect upon foot imposed forces. In one embodiment, the supports are arranged to deflect independently of an adjacent support to enhance the cushioning and response of the shoe to the foot imposed forces.

The transversely extending suspension system may resiliently support the foot and deflect downwardly in a variety of ways, as the present invention is not limited in this respect. For example, in one embodiment, the suspension system includes a deflectable grid system. The grid system may include a plurality of fibers forming a net, defining an impact absorbing member. The grid system may act like a tennis racquet, absorbing energy into the fibers upon deflection of the grid, releasing the stored energy back into the foot upon the removal of the force. Typically, during a gait cycle, the foot initially contacts the ground in the heel portion of the shoe. When the suspension system is located in the heel portion, this initially increases the foot imposed forces, causing the suspension system to deflect until the force peaks during the gait cycle. Then, as the midfoot and forefoot portions of the foot contact the ground, the foot imposed forces in the heel portion decrease, causing the suspension system to release some of the energy stored in the deflection of the system back into the foot. In one embodiment, the grid may be formed out of a plurality of spaced apart filaments extending in a crisscross pattern. In another embodiment, the grid system may be formed by a molding process, where the grid is formed into parts of the midsole of the shoe. Numerous other approaches to forming a deflectable grid system are discussed in the patents referenced above in the Background section.

In other embodiments, the suspension system may be formed into configurations other than a deflectable grid system. For example, the suspension system may include a taut resilient material acting like a trampoline upon foot imposed forces. In such a design, the resilient material absorbs energy as the material deflects, and it releases the energy back into the foot upon the removal of the force. Further embodiments may employ other resilient materials, such a springs, foams, and/or elastically deformable materials, as the present invention is not limited in this respect.

According to one aspect of the invention, an athletic shoe sole includes a plurality of supports or pillars in the heel portion of the shoe. The pillars may be spaced apart around the periphery of the shoe heel. The pillars may define individual ground engaging surfaces on the sole of the shoe. In one embodiment, the shoe sole includes at least one pillar positioned on the lateral side of the shoe, at least one pillar on the medial side of the shoe, and at least one pillar in the rear portion of the heel. Many conventional shoe soles are designed with only one heel ground engaging surface. However, in one embodiment, each pillar may define a distinct ground engaging surface. In one embodiment, the center of the heel portion is free of pillars to accommodate for the placement of the above-described energy return suspension system.

As will be described in further detail below, the shoe sole construction may be incorporated into various types of athletic shoes. For example, the shoe sole may be used for walking shoes, running shoes, basketball shoes, etc. Additional materials may be incorporated into the midsole and/or outsole to provide further cushioning, support, or stability to the wearer, as the present invention is not limited in this respect.

Figure 2:
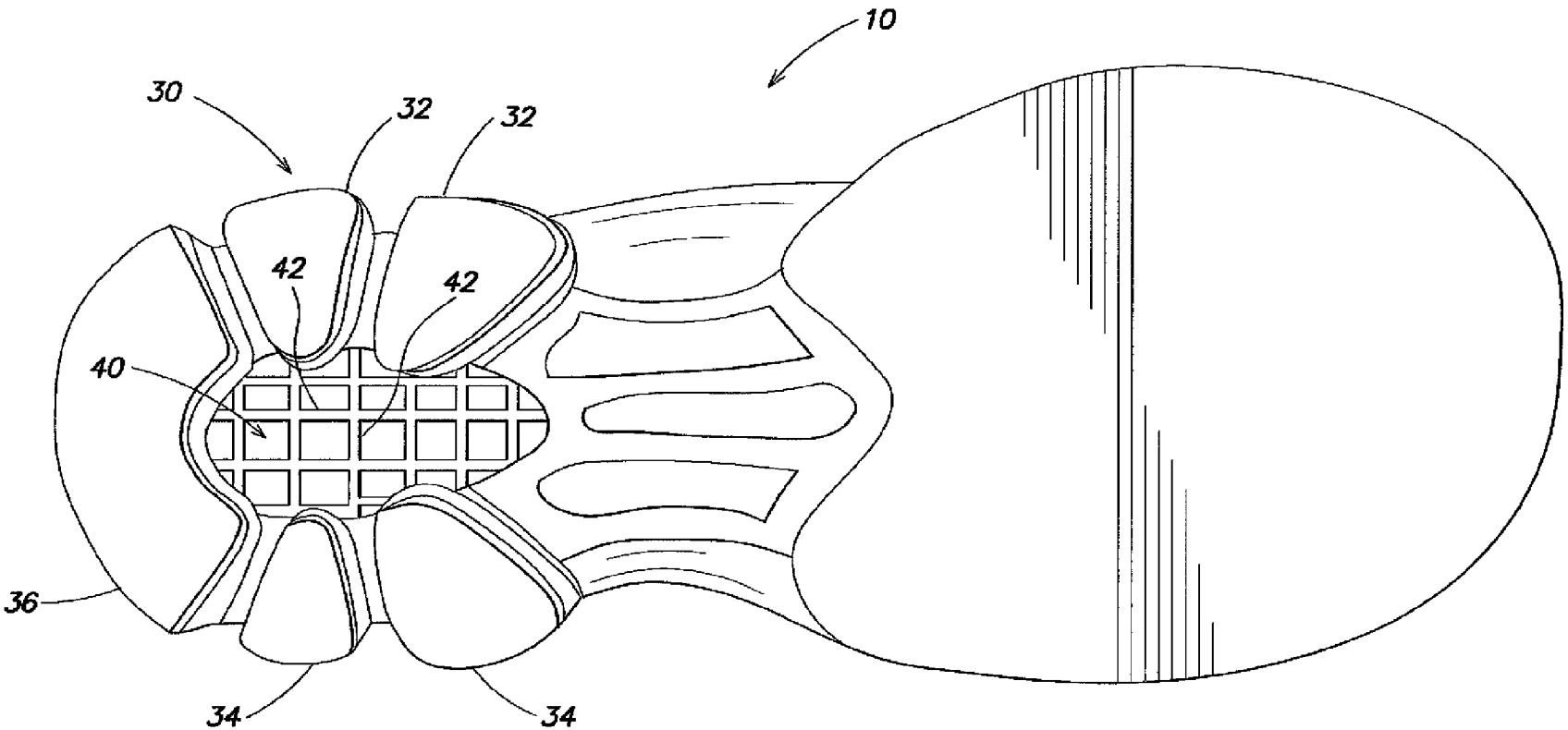
FIG. 2 is a bottom view of the shoe illustrated in FIG. 1.
Figure 3:
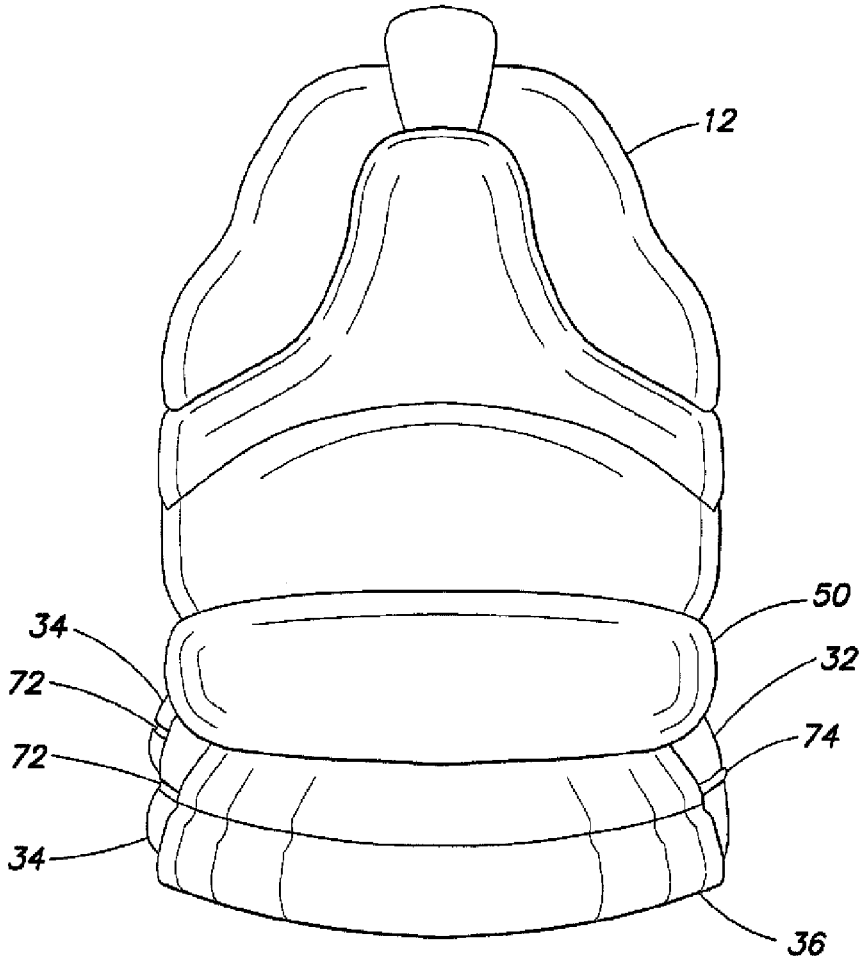
FIG. 3 is a rear view of the shoe illustrated in FIG. 1.

Turning now to the drawings, and in particular with reference to FIGS. 1-3, a shoe sole construction according to one aspect of the invention will now be described. The shoe 10 includes an upper 12 attached to a sole 14. In the embodiment disclosed in FIGS. 1-3, the upper 12 and sole 14 both extend from the heel portion 20 of the shoe, through the midfoot 22 and to the forefoot portion 24 of the shoe. In the heel portion 20, there are a plurality of supports or pillars 30 in the sole. As shown in FIG. 2, there are two lateral side pillars 32, two medial side pillars 34, and one heel pillar 36 positioned at the rear of the heel portion of the shoe 10, which are positioned around the perimeter of the heel portion to accommodate a suspension system, such as an energy return grid system 40. This particular grid system 40 consists of a plurality of monofilaments or fibers 42 extending across to form a net or mesh arrangement. As described above, the energy return grid system 40 stores energy during the compression portions of the gait cycle and releases energy during the push-off phase of the gait cycle. As discussed above, in other embodiments, the suspension system may include other various types of resilient deflectable materials.

Figure 4:
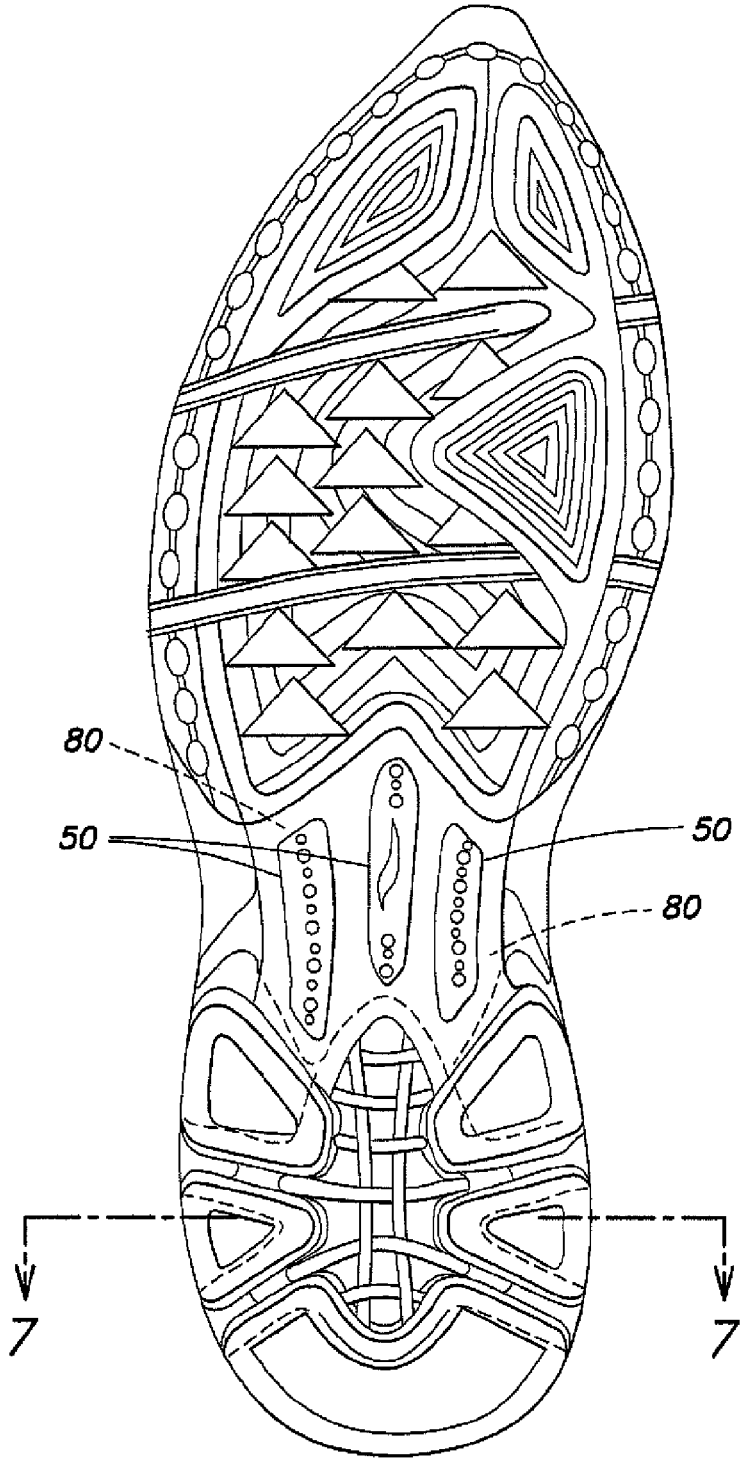
FIG. 4 a bottom view of one embodiment of a shoe sole.
Figure 5:
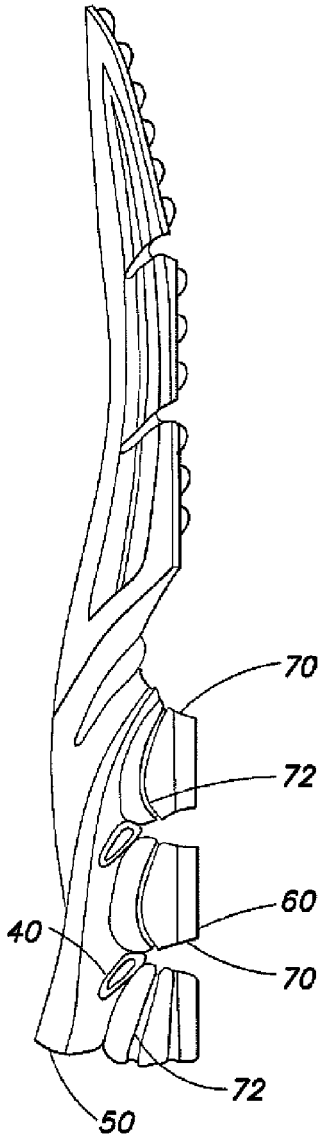
FIG. 5 is a lateral side view of the shoe sole illustrated in FIG. 4.
Figure 7:
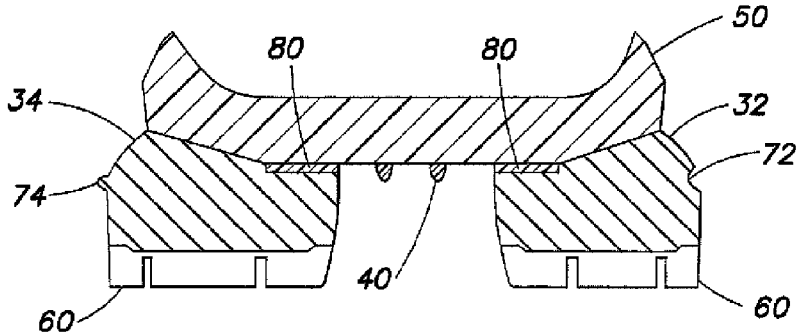
FIG. 7 is a cross-sectional view of the shoe sole taken along the line 7-7 of FIG. 4.
Figure 8:
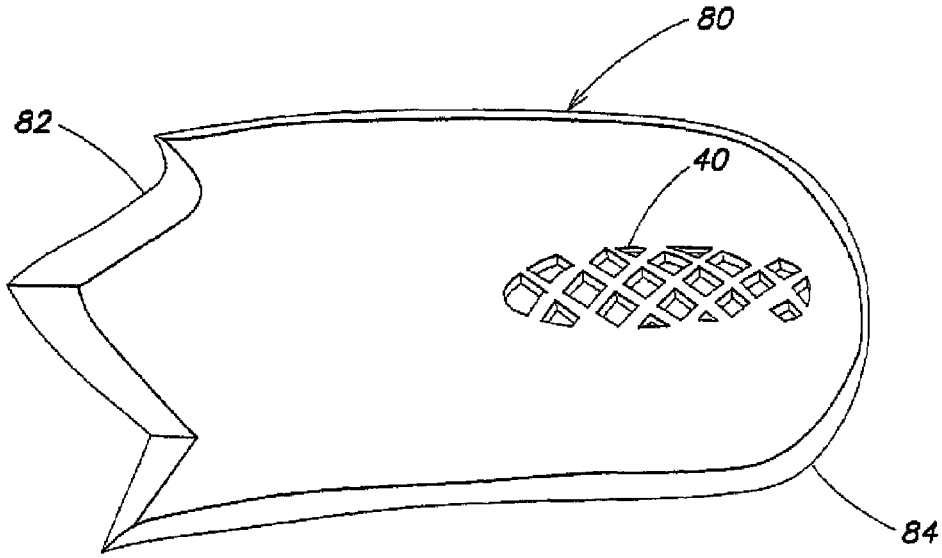
FIG. 8 is a perspective view of a suspension system located in a midsole portion of the shoe.

As described in more detail below, the suspension system, such as the energy return grid system 40, is incorporated into portions of the shoe positioned above the support pillars 30. The grid system 40 may be made from a plurality of fibers 42 woven into a net, similar to a tennis racquet. In this embodiment, the ends of the fibers may be anchored into a frame as described in some of the patents referenced in the Background section above. Alternatively, the grid system 40 may be molded into a footbed or shank 80 (See FIG. 8) which extends across at least part of the heel portion of the shoe. In one embodiment, as shown in FIGS. 4, 7 and 8, the grid system 40 is molded into a shank 80 which is sandwiched between the pillars 40 and midsole 50. In this embodiment, the shank 80 extends from the heel into the midfoot portion of the shoe and part of the grid system 40 wraps around to the medial and lateral sides of the midsole 50 as shown in FIGS. 5 and 7. As illustrated in FIG. 4, portions of both the shank 80 and the midsole 50 are visible from the bottom side of the shoe in the midfoot portion.

Figure 6:
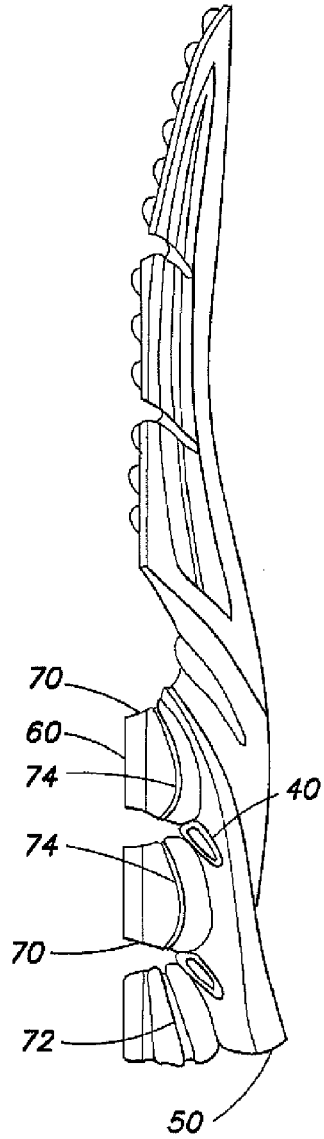
FIG. 6 is a medial side view of the shoe sole illustrated in FIG. 4.

Each support pillar 30 may be formed into a variety of shapes and sizes, as the present invention is not limited in this respect. For example, in one embodiment, the lateral and medial pillars 32, 34 are substantially similar in appearance. As illustrated in FIGS. 4-7, the lateral and medial pillars 32, 34 have a triangular cross-sectional area, and the heel pillar 36 has a larger cross-sectional area, having a C-shaped cross-section. Each pillar extends in a generally vertical direction from the midsole 50 to the bottom of the shoe, which is typically defined by the ground engaging outsole 60. As shown in FIGS. 1, 5 and 6, the side walls 70 of the pillars may be slightly angled so the cross-section of the pillar either increases, decreases, or remains substantially constant along the height of the pillar 30.

In the embodiment depicted in FIGS. 5-7, the lateral pillars 32 and the heel pillar 36 have a groove 72 positioned midway up the height of the pillars that extends at least partially around the perimeter of the pillar. The groove 72 allows the pillar to compress more than if the side wall 70 of the pillar is uninterrupted. Conversely, as depicted in FIGS. 6-7, the pillars 34 on the medial side have a ring-like protrusion 74 midway up the height of the pillar that also extends at least partially around the perimeter of the pillar. The protrusion 74 provides additional support to the pillars, making each pillar more rigid than without the protrusion 74. In one embodiment, the protrusions 74 are formed from a material more rigid than the pillars, however, in other embodiments the protrusions are integrally formed with the pillar. To prevent pronation of the foot, in one embodiment, it is preferred to have the protrusions 74 located on the medial side of the shoe, however, in other embodiments, it may be beneficial to have the protrusions on at least some of the lateral and/or heel pillars as well.

As described above, the support pillars 30 may be arranged to resiliently deflect upon foot imposed forces. In one embodiment, each support pillar 30 includes a ground engaging section and a resilient section intermediate the ground engaging section and the suspension system that collectively provide support for the suspension system, while permitting the suspension system to deflect as well. Although these two sections may be formed from the same material, in some embodiments, the ground engaging material is formed from a material that is more rigid that the resilient section of the supports.

Figure 9:
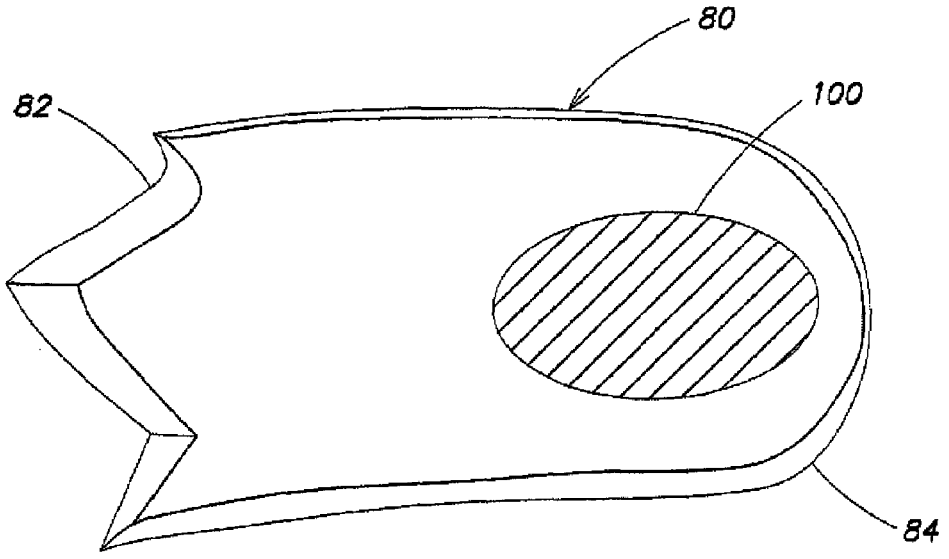
FIG. 9 is a perspective view of another suspension system located in a midsole portion of the shoe.

Turning to FIGS. 8 and 9, as discussed above, the suspension system 100 may be incorporated into portions of the midsole. As illustrated in the embodiment of FIG. 8, a deflectable grid system 40 is included in the shank 80. In this particular embodiment, the shank extends from a midfoot end 82 to a heel end 84, and the grid system 40 is integrally molded into the shank 80. Alternatively, as shown in FIG. 9, portions of the midsole, such as the shank 80, may include other types of suspension systems 100. As shown, the suspension system 100 may include various resilient materials.

The shoe sole of the present invention may be made from any number of materials, as the present invention is not limited in this respect. For example, the midsole 50, may be made of EVA (Ethylene Vinyl Acetate), polyurethane, or a combination of the two materials. In one embodiment, the resilient sections of the pillars 30 are also made of EVA, and the shank 80 with the molded grid system 40 is made of TPU (thermoplastic polyurethane). To provide additional cushioning, the pillars may be made of SRC (Super Rebound Compound) which is an EVA/rubber compound. Further, as illustrated in FIG. 7, the ground engaging sections, such as the bottom of the pillars 30, may include an outsole 60 which is made of a carbon rubber outsole material.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. An athletic shoe construction having a transversely extending suspension system designed to resiliently support a foot and deflect downwardly upon foot imposed forces, comprising:

a plurality of independent supports arrayed about the periphery of the suspension system and extending downwardly therefrom, said supports including a lower ground engaging section and an upper resilient section intermediate the ground engaging section and the suspension system, said supports collectively providing a flexible resilient support for the suspension system; and wherein the ground engaging section is spaced apart from the suspension system and positioned below the upper resilient section and is formed of a more rigid material than the resilient section, and wherein each independent support is separate from an adjacent independent support substantially up to the suspension system.

2. The athletic shoe construction of claim 1, wherein the suspension system is located in a heel portion of the shoe.

3. The athletic shoe construction of claim 1, wherein the suspension system comprises a deflectable grid.

4. The athletic shoe construction of claim 1, wherein the suspension system is located in a midsole portion of the shoe.

5. The athletic shoe construction of claim 3, wherein the deflectable grid is formed into a midsole portion of the shoe.

6. The athletic shoe construction of claim 1, wherein portions of the resilient section of the independent supports include at least one of, a groove and a protrusion, extending at least partially about the outer surface of the resilient section.

7. An athletic shoe sole construction comprising:

a transversely extending suspension system designed to resiliently support a foot and deflect downwardly upon foot imposed forces;

an independent support structure positioned underneath the suspension system, the support structure including a plurality of ground contacting sections extending about the periphery of a heel portion of the shoe sole, and a plurality of resilient sections positioned directly above the ground contacting sections, wherein the ground contacting sections are spaced apart from the suspension system and are formed of a more rigid material than the resilient sections, and wherein deflection of a first resilient section is independent from the deflection of an adjacent second resilient section, and wherein the height of the independent support structures is greater than the height of the suspension system.

8. The athletic shoe sole construction of claim 7, further comprising at least one ground contacting section positioned on the lateral side of the sole, at least one ground contacting section positioned on the medial side of the sole, and at least one ground contacting section positioned on the rear part of the heel portion of the sole.

9. The athletic shoe sole construction of claim 7, wherein the independent support structure is adjacent the suspension system.

10. The athletic shoe sole construction of claim 7, wherein the suspension system comprises a deflectable grid.

11. The athletic shoe sole construction of claim 10, wherein the deflectable grid is located in a midsole portion of the shoe.

12. An athletic shoe sole construction having a transversely extending suspension system designed to resiliently support a foot and deflect downwardly upon foot imposed forces, comprising:

a structure supporting the suspension system from below, the structure including a plurality of resiliently compressible pillars arranged around the periphery of a heel portion of the suspension system, and wherein a first pillar is constructed and arranged to deflect independently of an adjacent second pillar, wherein the height of the pillars is greater than the height of the suspension system and wherein the height of the pillars forms a majority of the overall height of the shoe sole; and wherein the plurality of resiliently compressible pillars include a resilient section and a ground engaging section positioned below the resilient section, wherein the ground engaging section is spaced apart from the suspension system and is formed of a more rigid material than the resilient section.

13. The athletic shoe construction of claim 12, further comprising at least one lateral side pillar, at least one medial side pillar, and at least one heel pillar.

14. The athletic shoe construction of claim 13, wherein the heel pillar has a larger ground engaging surface than either of the medial or lateral side pillars.

15. The athletic shoe construction of claim 13, wherein at least one of the lateral side pillar and the heel pillar includes a groove extending at least partially about the perimeter of the pillar.

16. The athletic shoe construction of claim 13, wherein at least one medial side pillar includes a protrusion extending at least partially about the perimeter of the pillar.

17. The athletic shoe construction of claim 12, wherein the suspension system comprises a deflectable grid.

* * * * *